US008224234B1

(12) United States Patent
Schuster et al.

(10) Patent No.: US 8,224,234 B1
(45) Date of Patent: Jul. 17, 2012

(54) METHOD AND APPARATUS FOR GENERATION OF RADIO FREQUENCY JAMMING SIGNALS

(75) Inventors: Gary P. Schuster, Larwill, IN (US); John A. Smith, Albion, IN (US); Walter F. Schoonover, Jr., Leo, IN (US)

(73) Assignee: Raytheon Company, Waltham, MA (US)

( * ) Notice: Subject to any disclaimer, the term of this patent is extended or adjusted under 35 U.S.C. 154(b) by 305 days.

(21) Appl. No.: 12/762,273

(22) Filed: Apr. 16, 2010

Related U.S. Application Data

(60) Provisional application No. 61/169,959, filed on Apr. 16, 2009.

(51) Int. Cl.
*H04K 3/00* (2006.01)

(52) U.S. Cl. ..... 455/1; 342/13; 342/14; 342/15

(58) Field of Classification Search ... 455/1; 342/13–15
See application file for complete search history.

(56) References Cited

U.S. PATENT DOCUMENTS 7,817,706 B2 * 10/2010 Karlsson ..... 375/134
2007/0297489 A1 * 12/2007 Karlsson ..... 375/134

* cited by examiner

*Primary Examiner* — Fayyaz Alam
(74) *Attorney, Agent, or Firm* — Daly, Crowley, Mofford & Durkee, LLP

(57) ABSTRACT

A system for generation of jamming signals and related and techniques are described.

18 Claims, 8 Drawing Sheets

METHOD AND APPARATUS FOR GENERATION OF RADIO FREQUENCY JAMMING SIGNALS

CROSS-REFERENCE TO RELATED APPLICATIONS

This application claims priority under 35 U.S.C. §119(e) from U.S. Provisional Patent Application No. 61/169,959, filed Apr. 16, 2009, which application is hereby incorporated herein by reference in its entirety for all purposes.

FIELD OF THE INVENTION

The systems and techniques described herein relate to signal generation and more particularly to generation of multiple independent jamming signals over a multi-octave frequency range.

BACKGROUND OF THE INVENTION

As is known in the art, a device used in electronic warfare to inhibit, impede or halt the transmission of signals is sometimes referred to as a "jammer." It is desirable for jammers to have the ability to generate wideband, diverse waveforms. Conventional techniques to produce such wideband, diverse waveforms are typically implemented by generating multiple jamming signals and combining them via a single wideband power amplifier.

One problem with this approach, however, is that such wideband power amplifiers typically produce a significant amount of unintentional interference due to transmitter spurious signals. Such spurious signals can reduce transmitter efficiency by taking energy away from the desired jam signals. Such spurious signals can also result in interference with signals at frequencies used for communication, navigation, and identification friend-or-foe (IFF) systems. Furthermore, prior art techniques are limited in intermediate frequency (IF) bandwidth, radio frequency (RF) signal range and the ability to generate multiple signals in contiguous bandwidths from DC to an upper frequency limit of an RF upconverter.

SUMMARY OF THE INVENTION

In accordance with the systems, techniques and concepts described herein, a system for generating wideband radio frequency (RF) jamming signals using digital techniques is described. Such a system and technique provides the ability to generate many different types of RF jamming signals (e.g. AM, FM, PM, CDMA, OFDM, swept, etc.) for the purpose of jamming RF signals. In one embodiment, this is accomplished by generating multiple, simultaneous signals over an intermediate frequency (IF) bandwidth (BW) (e.g. of 200 MHz, in one example) at an RF frequency of 0 Hz to an upper frequency limit established by a quadrature modulator circuit used to upconvert the baseband signal to RF.

The system is modular in that each IF BW can be arranged to form contiguous BWs of operation from DC to the upper frequency limit. In one embodiment, the system uses a field programmable gate array (FPGA) to generate a baseband signal (e.g. by programming the FPGA to operate as a digital signal generator). The system may optionally include a digital signal processor (DSP) and a digital-to-analog converter (DAC). In other embodiments, other types of processing elements may be used.

The system, techniques and design described herein utilize one or more digital signal generators, one or more DACs operated in quadrature, a quadrature modulator, and a pair of analog, amplitude and phase matched anti-alias filters to generate RF jamming signals. The RF jamming signals may be provided as, but are not limited to, amplitude modulated (AM) signals, frequency modulated (FM) signals, phase modulated (PM) signals, carrier division multiple access (CDMA) signals, orthogonal frequency division multiplexed (OFDM) signals, swept signals, etc. . . .

With this particular arrangement, a system and technique to provide multiple independent jamming signals over a multi-octave frequency range is provided. The system and technique described herein provides wide instantaneous bandwidth of up to ±80% of Nyquist frequency range for each FPGA/quadrature DAC pair/quadrature modulator processing chain (also sometimes referred to herein as a "thread"). Each thread is capable of generating RF jamming signals at low frequencies, typically below the Nyquist frequency, directly from the DACs, or at higher frequencies operating the DACs in quadrature and translating the spectrum up in frequency through the use of a quadrature modulator, local oscillator and/or adding another mixer stage for upconversion. The system is expandable both up and down in RF frequency using the same basic architecture.

Utilizing simultaneous, diverse jam signals in multi-octave bandwidths provides contiguous frequency coverage from DC to an upper (or maximum) RF frequency. Inter-modulation products are reduced (and sometimes can be minimized) through the use of a sub-octave, multiplexed filter network to reduce transmitter spurious signals, RF fratricide and interoperability with communications equipment.

In embodiments, in which the digital signal generator is implemented via an FPGA, programmable signal processing functions can be downloaded to the FPGA to support new jamming techniques in order to adapt to new requirements. Thus, by using an FPGA to implement a digital signal generator, the device is reconfigurable/reprogrammable.

In accordance with a further aspect of the concepts systems and techniques described herein a jamming system includes: a plurality of digital signal generators each of which generates a pair of digital quadrature signals; a plurality of digital filters, each of the plurality of digital filters having inputs coupled to receive a pair of digital quadrature signals from a corresponding one of said plurality of digital signal generators and to provide filtered quadrature digital signals at a pair of outputs thereof; a plurality of quadrature digital-to-analog (D/A) converter pairs, each of said plurality of quadrature D/A converters pairs disposed to receive one or more independent pairs of filtered quadrature jamming signals from a corresponding one or more of said plurality of digital filters and to provide one or more independent quadrature signal spectrum pairs at a pair of outputs thereof; a plurality of quadrature modulators, each of said plurality of quadrature modulators having a first port coupled to receive a first one of the quadrature pairs of analog quadrature signal spectrums from a corresponding one of said quadrature D/A converters, having a second port coupled to receive a second one of the pair of analog quadrature signal spectrums from the corresponding one of said quadrature D/A converters, having a third port configured to receive a local oscillator signal and having an output port at which an output signal is provided; a plurality of amplifiers, each of said amplifiers having an input port coupled to one or more output ports of a corresponding one or more of said plurality of quadrature modulators and having an output port coupled to the output of the jamming system.

In one embodiment, the system may further include a plurality of filters, each of said plurality of filters having an input port coupled to an output port of a corresponding one of said plurality of amplifiers and having an output port coupled to the output of the jamming system.

In a further embodiment, each of the plurality filters of may be provided having a sub octave band pass filter characteristic.

In a further embodiment, each of the plurality of quadrature digital-to-analog (D/A) converter pairs is provided having a first input coupled to receive a first one of the pair of quadrature independent signal spectrums from the corresponding one or more of the plurality of digital filters and a second input coupled to receive a second one of the pair of quadrature independent signal spectrums from the corresponding one or more of the plurality of digital filters.

The system can further include one or more of the following features: each of the plurality of amplifiers is provided as a power amplifier; a plurality of analog filter pairs, each of the plurality filter pairs having inputs disposed to receive analog signal spectrums from a corresponding one of the like plurality of quadrature D/A converter pairs and having an output coupled to an input of a corresponding one of the plurality of quadrature modulators; and each of the plurality of analog filter pairs is provided having suitable antialiasing characteristics for the corresponding D/A converter pair and signal spectrum.

In accordance with a further aspect of the present invention, a jamming system for providing multiple independent jamming signals over a multi-octave frequency range includes: a plurality of digital signal generators each of which generates a pair of signals in quadrature; a plurality of digital filter pairs, each of the plurality of digital filters disposed to receive signals from a corresponding one of said plurality of signal generators; a plurality of quadrature digital-to-analog (D/A) converter pairs, each of said plurality of quadrature D/A converter pairs disposed to receive signals from a corresponding one or more of said plurality of digital filter pairs; a plurality of quadrature modulators, each of said plurality of quadrature modulators having a first port coupled to receive a first one of the pair of quadrature signal spectrums from a corresponding one of said quadrature D/A converters, having a second port coupled to receive a second one of the pair of quadrature signal spectrums from the corresponding one of said quadrature D/A converters, having a third port configured to receive a local oscillator signal and having an output port at which an output signal is provided; a plurality of power amplifiers, each of the power amplifiers having an input port coupled to one or more output ports of a corresponding one or more of said plurality of quadrature modulators and having an output port; and a plurality of filters, each of said plurality of filters having a sub octave band pass filter characteristic and each having an input port coupled to an output port of a corresponding one of said plurality of amplifiers and having an output port coupled to the output of the jamming system.

The system can further include one or more of the following features: a plurality of analog filter pairs, each of the plurality of analog low pass filter pairs having a pair of inputs disposed to receive signals from a corresponding one of the plurality of quadrature D/A converter pairs and having a pair of outputs coupled to a pair of inputs of a corresponding one of the plurality of quadrature modulators; wherein the plurality of analog low pass filters, provided in matched pairs correspond to anti-alias filters for the D/A converter; wherein the plurality of low pass filters correspond to phase and amplitude matched anti-alias filters; wherein the plurality of bandpass filters are provided as a sub-octave filter network provided having filter characteristics selected to reduce intermodulation products and to reduce transmitter spurious signals, reduce RF fratricide and improve interoperability with communications equipment; a plurality of local oscillator (LO) signal sources, each of the plurality of local oscillator signal sources having an input coupled to the LO input of a corresponding one of the plurality of modulators and each of the LO signal sources being independently tunable thereby allowing each modulator output signal to be independently and precisely placed in frequency space.

In accordance with a still further aspect of the present invention, a method for generating multiple independent jamming signals over a multi-octave frequency range, the method includes: generating a plurality of independent quadrature digital signal pairs; digitally filtering the plurality of independent quadrature digital signal pairs; converting the plurality of independent quadrature digital signal pairs in groups intended for conversion to the same sub octave RF frequency range and within frequency range of a single DAC pair, to quadrature analog signal spectrum pairs; filtering the quadrature analog signal spectrum pairs with matched analog anti-alias filter pairs to provide filtered quadrature analog signal spectrum pairs; up-converting the filtered quadrature analog signal spectrum pairs to a desired sub octave RF frequency range; amplifying the up-converted, filtered analog signal spectrums in sub octave groups; filtering the amplified, up-converted, filtered analog signal spectrum sub octave groups; and combining the amplified and filtered analog signal spectrum sub octave groups to provide the multiple independent RF jamming signals over a multi-octave RF frequency range.

The method can further include one or more of the following features: up-converting the filtered quadrature analog signals or spectrums to a desired frequency range comprises upconverting the filtered quadrature analog signals or spectrums to a desired frequency range via a quadrature modulator; generating a plurality of quadrature digital signals or spectrums comprises digitally generating multiple, independent jam signals in sub-octave bandwidths; wherein digitally generating multiple independent jam signals includes: generating a digital signal pair using a numerically controlled oscillator (NCO) and modulating the digital signal to provide the plurality of quadrature digital signals.

The method can still further include one or more of the following features: digitally filtering the plurality of quadrature digital signals by independently digitally filtering each of the plurality of quadrature digital signals in its own sub-octave bandwidth; and amplifying the up-converted, filtered quadrature analog signals by independently amplifying each of the up-converted, filtered quadrature analog signals in its own sub-octave bandwidth.

BRIEF DESCRIPTION OF THE DRAWINGS

The foregoing features of this invention, as well as the invention itself, may be more fully understood from the following description of the drawings in which.

DETAILED DESCRIPTION OF THE PREFERRED EMBODIMENTS

In accordance with the concepts disclosed herein, it was determined that a wide bandwidth (BW) approach to radio frequency (RF) jamming signal generation (e.g. countermeasures) addresses current and future requirements more effectively than conventional approaches. Thus, described herein is a wideband (WB) techniques generator comprised of one or more high speed field programmable gate arrays (FPGAs) which perform digital signal processing functions required to generate desired RF jamming signals. By generating signals in quadrature (I/Q space), modern signal modulation types as well as a classic jam signals can be generated.

Figure 1:
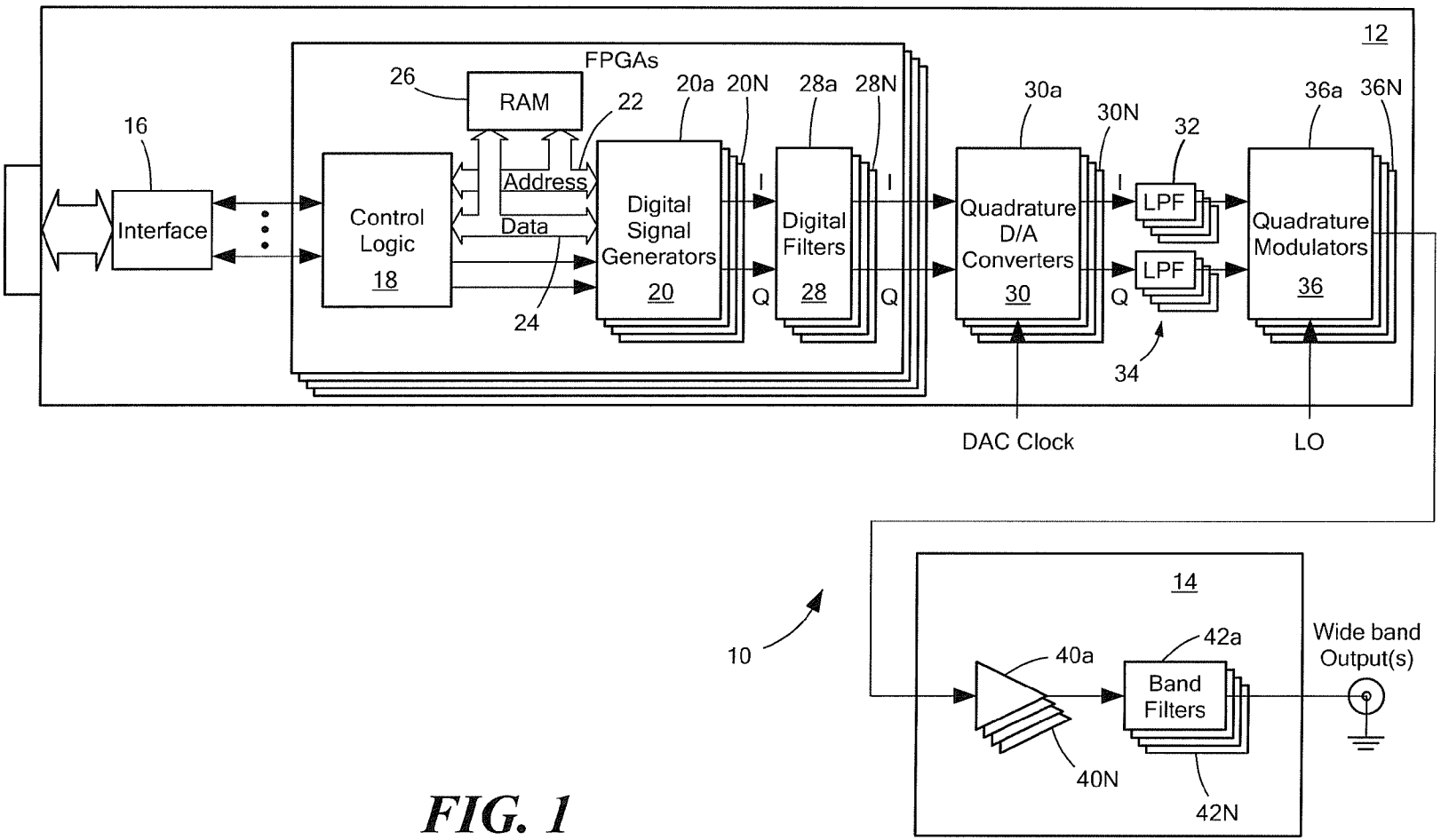
FIG. 1 is a block diagram of a radio frequency (RF) wideband techniques generator.

Referring now to FIG. 1, an apparatus for generation of wideband radio frequency jamming signals 10 includes a wideband exciter 12 which generates one or more jamming signals at a desired frequency or within a desired band of frequencies and provides the signals to an output port 10*a* through a power amplifier/multiplexor circuit (PA/MUX) 14.

Exciter 12 includes an interface 16 (e.g. a USB interface) to control logic circuitry 18 which in turn is coupled to a plurality of digital signal generators 20*a*-20N, generally denoted 20, through address and data buses 22, 24. Memory 26 is also coupled to control logic circuitry 18 and digital signal generators 20 through buses 22, 24. Control logic is used to decode commands received by the FPGA in order to determine which jamming functions (or waveforms) are enabled or disabled. Control logic also determines what information is stored in memory for use as a part of the jamming techniques discussed below.

Each of the plurality of digital signal generators 20 generates a pair of signals which are in phase quadrature (designated as in-phase or "I" and quadrature phase or "Q" in FIG. 1). The IQ signals from each digital signal generator are fed to corresponding ones of a plurality of digital filters 28*a*-28N, generally denoted 28. Digital filters provide filtered quadrature signals IQ at outputs thereof. It should be appreciated that in practice, digital filters 28 may be provided as interpolation filters which are implemented in the DAC.

In one embodiment, control logic circuitry 18, memory 26, digital signal generators 20 and filters 28 may all be provided as part of an FPGA.

Exciter 12 further includes a plurality of quadrature digital-to-analog (D/A) converters 30*a*-30 N generally denoted 30, each of which receives a pair of filtered quadrature signals IQ from a corresponding one of the plurality of digital filters 28. D/A converters 30 provide a pair of analog quadrature signals IQ at outputs thereof. The analog in-phase signals I from each DAC 30 are coupled through corresponding ones of a plurality of low pass filters 32 to corresponding ones of a plurality of quadrature modulators 36. Similarly, the analog quadrature-phase signals Q from each DAC 30 are coupled through corresponding ones of low pass filters 34 to corresponding ones of the plurality of quadrature modulators 36. Filters 32, 34 are preferably phase and amplitude matched filters.

Thus, each of the plurality of quadrature modulators have a first port coupled to receive a first one of the pair of analog quadrature signals from a corresponding one of the quadrature D/A converters and a second port coupled to receive a second one of the pair of analog quadrature signals from the corresponding one of the quadrature D/A converters. Each of the plurality of quadrature modulators are also configured to receive a local oscillator (LO) signal which mixes with the filtered analog I and Q signals to produce signals at outputs thereof.

The output signals from the plurality of quadrature modulators are provided to corresponding ones of a plurality of amplifiers 40*a*-40N generally denoted 40. In one embodiment, it may be desirable to have one amplifier per suboctave band and thus it may be desirable for each power amplifier to have a frequency range of slightly greater than an octave of frequency. Each of the amplifiers 40 have an input port coupled to an output port of a corresponding one of the plurality of quadrature modulators 36 and have an output port coupled to the output of the jamming system through a plurality or bank of filters 42*a*-42N generally denoted 42. In one embodiment, each filter 42 operates over a suboctave band.

In one embodiment, each filter bank 42*a*-42N is dedicated to a sub-octave bandwidth in order to address an entire frequency range (which may for example correspond to an entire threat range).

The architecture shown in FIG. 1 may be implemented with commercially available FPGA, quadrature DAC, quadrature modulator components and a set of wideband, phase coherent anti-alias filters 32 to generate the RF jamming signals (AM, FM, PM, CDMA, OFDM, swept, etc.).

Wide instantaneous bandwidth is achieved for each DAC that is expandable both up and down in RF frequency using the same basic architecture using either direct modulation from the DACs, tuning the local oscillator to the quadrature modulator and/or adding another mixer stage for upconversion. Simultaneous, diverse jam signals in multiple bandwidths to provide substantially maximum contiguous frequency coverage from DC to an upper (or maximum) RF frequency. Inter-modulation products are minimized through the use of a sub-octave filter network (shown as "band filters 42" in the PA/MUX 14 in FIG. 1) to reduce transmitter spurious signals, RF fratricide and interoperability with communications equipment. Utilizing an FPGA allows the device to be reconfigurable. In particular, programmable signal processing functions are downloadable to the FPGA to support new techniques in order to adapt to new requirements. Furthermore, the modular nature of the hardware, firmware and software allows for upgrades to address future signal requirements.

It should also be appreciated that the benefits of the architecture and techniques disclosed herein include, but are not limited to: (a) wide instantaneous bandwidth (of up to 200 MHz with the example shown) for each DAC; (b) frequency agile operation (provided by each LO being independently tunable allowing each wide bandwidth to be placed precisely in frequency space); (c) the system is modularly expandable (meaning that two or more bandwidths can be used together (contiguous in frequency space) or independently to provide broad frequency coverage); (d) flat frequency response provided when operating two or more bandwidths contiguously in frequency space (i.e., stacked operation); flat spurious response is achieved when two or more bandwidths are operated in frequency space such that there is contiguous frequency coverage, there is no roll off or degraded spurious versus frequency (all DACs operate at baseband (First Nyquist Zone) for best spurious floor performance); simultaneous, diverse jam signals in multiple bandwidths provide substantially maximum contiguous RF jamming coverage; inter-modulation performance (the system has improved levels of transmitter spurious signals, reduced RF fratricide and increased interoperability with communications equipment); the system is expandable both up and down in frequency using the same basic architecture using either direct modulation from the DACs or adding another mixer stage for upconversion; the system is easily reconfigurable using state-of-the-art FPGAs; and the system has programmable signal processing functions that are downloadable to support new RF jam signal techniques.

Conventional narrowband approaches are implemented by generating multiple jam signals and combining them into a single wideband power amplifier which results in a significant amount of unintentional interference due to transmitter spurious signals. These signals reduce transmitter efficiency by taking energy away from the desired jam signals. These signals also create interference on other frequencies that are used for communication, navigation, and identification friend or foe (IFF).

The system, techniques and concepts described herein, on the other hand, provide multiple jam signals that are digitally generated in sub-octave bandwidths, each bandwidth having its own power amplifiers and filtering. In this way, the jamming is more surgical (i.e. precise or localized) in nature, countering multiple threats simultaneously, while reducing (or in some cases even minimizing) transmitter spurious products. Thus, one result of the systems and techniques described herein is a frequency spectrum that is better managed and in which unintentional interference is reduced and in some cases minimized.

It should also be appreciated that variants of the architecture described in conjunction with FIG. 1 are also possible. For example, in some embodiments it may be desirable to use like numbers of digital signal generators and digital filters and pass the resulting signals through a single DAC. For example, when all signals that are targets of jamming require jamming signals that are of the same or similar structures then the jamming signals are likely to be signals that employ like numbers of digital signal generators and digital filters. Alternatively still, it may be necessary or desirable to have different numbers of digital signal generators, digital filters, DACs and quadrature modulator circuits. Again, for example, when signals that are targets of jamming require jamming signals that are not of the same or similar structures then the jamming signals are not likely to be signals that necessarily employ like numbers of digital signal generators and digital filters. Alternatively still, it may be desirable to pair DACs and quadrature modulator circuits, but not necessarily have the same number of signal generators and digital filters. Again, for example, when signals that are targets of jamming require jamming signals that are of the not the same or similar structures then the jamming signals are not likely to be signals that necessarily employ like numbers of digital signal generators and digital filters.

Figure 2:
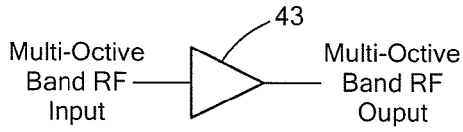
FIG. 2 is a block diagram of a prior art multi-octave system.
Figure 2A:
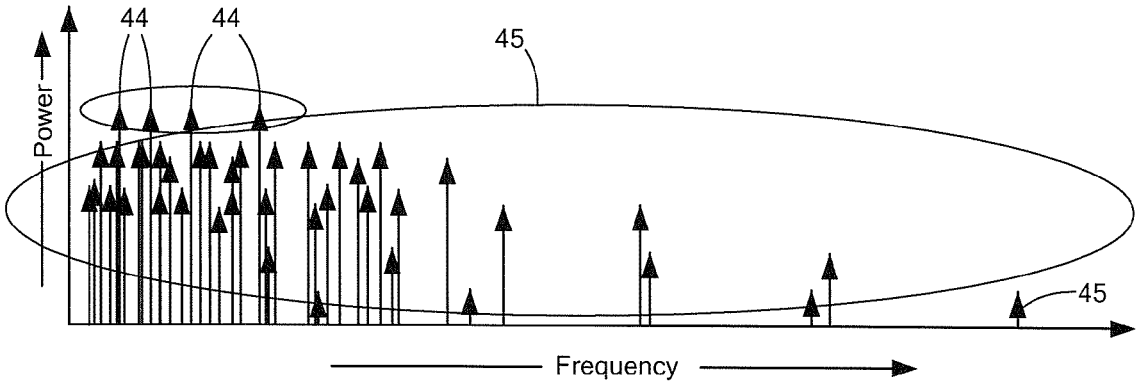
FIG. 2A is a plot of power vs. frequency which illustrates transmit spurious signals resulting from the prior art system.

Referring now to FIG. 2 a prior art system includes a multiband input signal provided to a broadband power amplifier (PA) 43 to produce a multi-band output signal. An exemplary multi-band output generated by the architecture shown in FIG. 2 is illustrated in FIG. 2A. This example is for one signal per sub octave RF frequency band. As shown in FIG. 2A, desired transmit signals 44 are engulfed by a plurality of non-desired transmitter spurious products generally denoted 45. The transmitter spurious products 45 shown in FIG. 2A correspond to single tone harmonics (to $5^{th}$ order) and two tone harmonics (to 3d order). It should be appreciated that three tone products and four tone products (all orders) are not included in FIG. 2A. Thus, in practical systems, there exists even a larger number of transmitter spurious products 45 than is shown in FIG. 2A.

Figure 3:
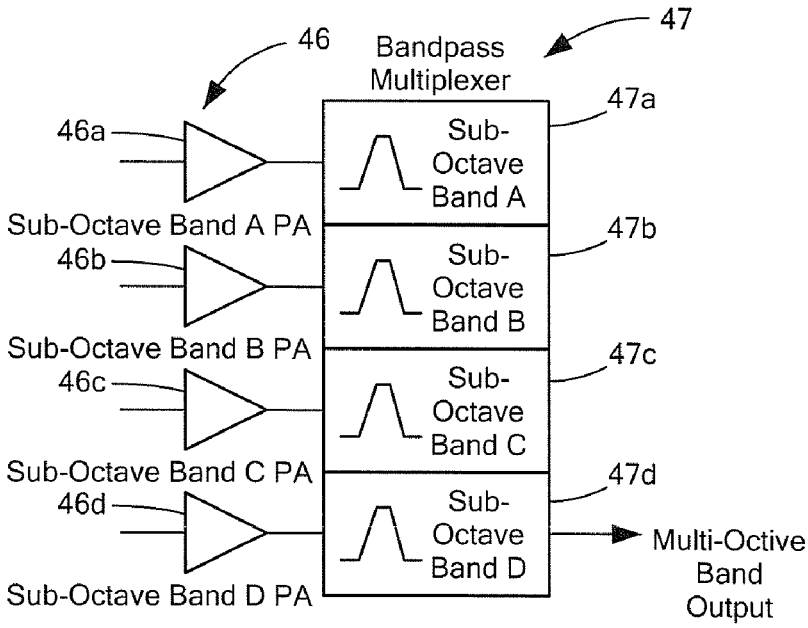
FIG. 3 is a block diagram of a multi-octave jamming system operating in accordance with sub-octave generation and amplification of jamming techniques.
Figure 3A:
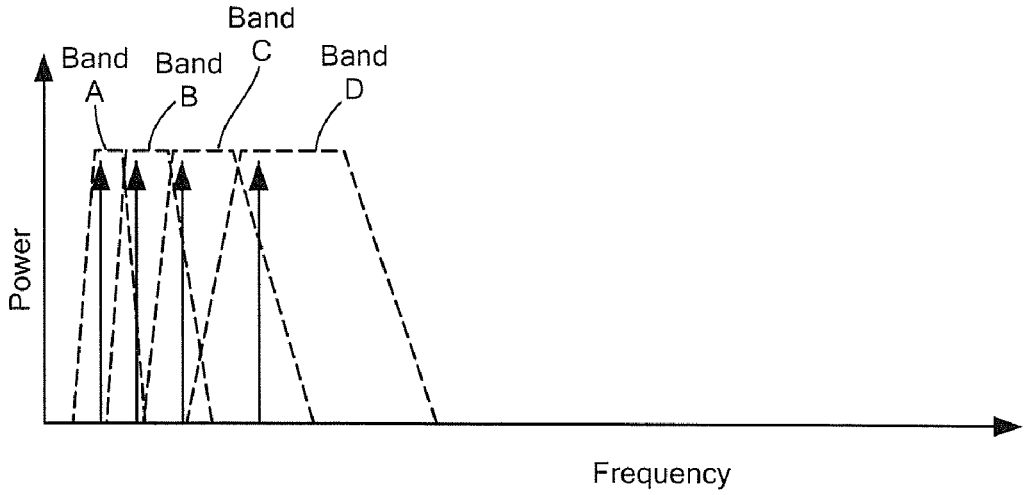
FIG. 3A is a plot of power vs. frequency which illustrates the reduction in spurious products achieved using a circuit and techniques in accordance with that discussed in conjunction with FIGS. 1 and 3.

FIGS. 3 and 3A illustrate the sub-octave band approach described herein (FIG. 3) and an exemplary frequency spectrum (FIG. 3A).

Referring now to FIG. 3, a plurality of power amplifiers, here four power amplifiers 46*a*-46*d*, provide digitally generated multiple jam signals (digitally generated in sub-octave bandwidths) to a plurality of filters, here four filters 47*a*-47*d*. Each of filters 47 is provided having a filter characteristic selected to pass only signals in a specified frequency band. Thus the system digitally generates multiple jam signals in separate bandwidths (with sub-octave bandwidths being shown in FIGS. 3, 3A) with each bandwidth having its own power amplifiers and filtering.

As can be seen from FIG. 3A, the result is a frequency spectrum in which interference from non-desired transmitter spurious products is reduced (and in some cases may even be minimized) compared with prior art techniques (e.g. as shown in FIG. 2A). As described above, this is accomplished by utilizing jamming which is more surgical in nature than prior art techniques while are the same time allowing countering of multiple threats simultaneously, while minimizing transmitter spurious products. Stated simply, FIGS. 3 and 3A illustrate that when multiple signals are being transmitted, the sub octave filters and limited bandwidth power amplifiers results in significantly reduced spurious signals and unintended interference.

The system and techniques described herein are capable of frequency extension to cover one or more desired frequency ranges (including an extended frequency range) by using parts appropriate for the desired frequency ranges.

Figure 4:
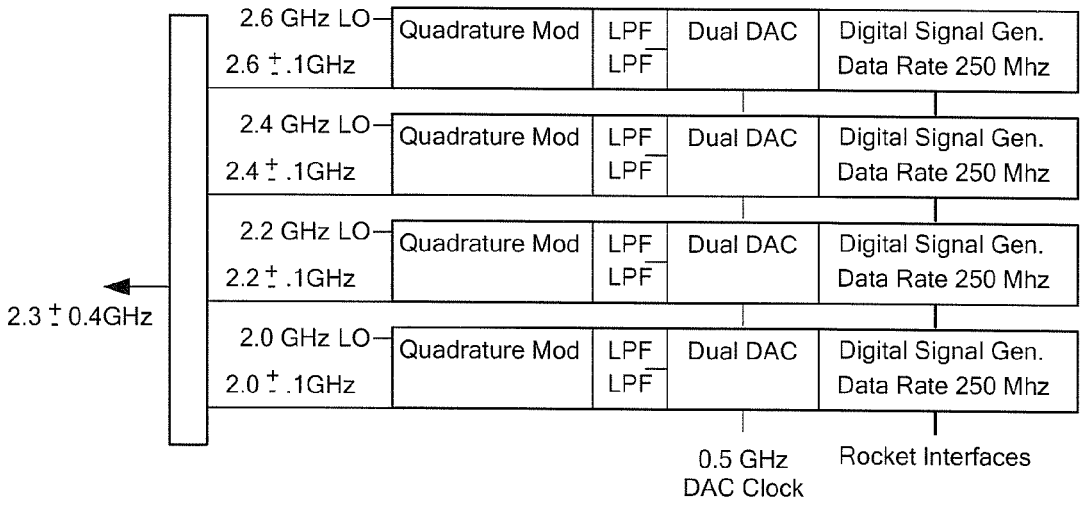
FIG. 4 is a block diagram of multiple RF outputs generated with four independently tuned local oscillator (LO) signals provided from four independently tuned digital signal generators.
Figure 5:
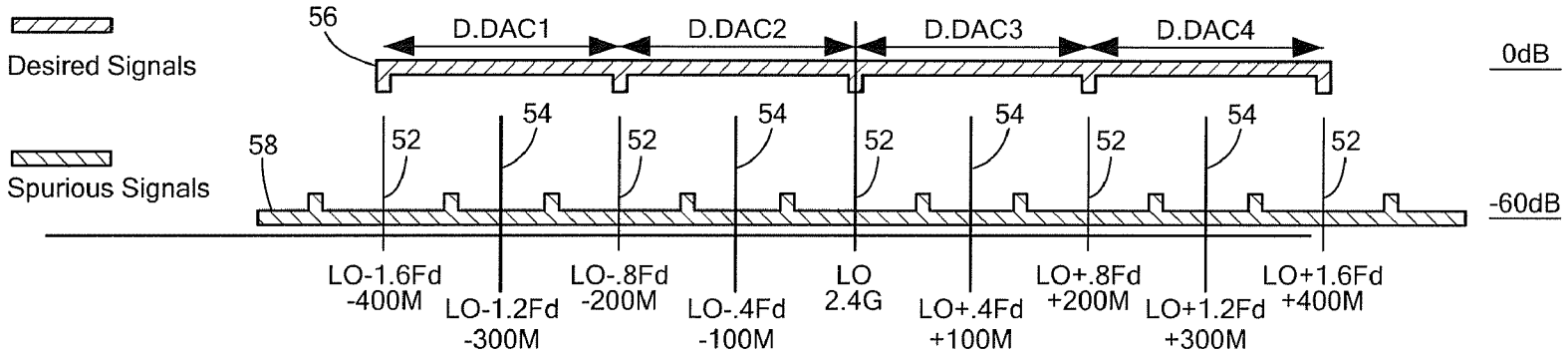
FIG. 5 is a plot of output response from multiple RF outputs with four independently tuned LOs.

Referring now to FIG. 4, independent local oscillator (LO) signals (e.g. RF signals at 2.0 GHz, 2.2 GHz, 2.4 GHz, 2.6 GHz) are used to drive each thread (where a thread is defined to be a set of processing elements that address one DAC bandwidth of RF spectrum). For analysis purposes, a BW centered about 2.3 GHz was chosen. FIG. 5 is the spectral output of the circuit shown in FIG. 4.

Referring now to FIG. 5, plot of frequency vs. power illustrates a contiguous 800 MHz frequency range addressed in four separate 200 MHz threads. The output of each thread is the region under D.DAC1 (thread 1), D.DAC2 (thread 2), etc. The output is a passband formed by the anti-alias filters with appropriate filter slopes on each end of the passband. In this embodiment, optimal spurious response is achieved when using the Nyquist band 1 output of each DAC as shown by the spurious response output level depicted in FIG. 5. This output is approximately −60 dBc from the desired signal output level as shown in FIG. 5. The output of each thread is the region under D.DAC1 (thread 1), D.DAC2 (thread 2), etc. The output is a passband formed by the anti-alias filters with appropriate filter slopes on each end of the passband. FIG. 5 illustrates an exemplary output of the circuit described in FIG. 4.

Figure 6:
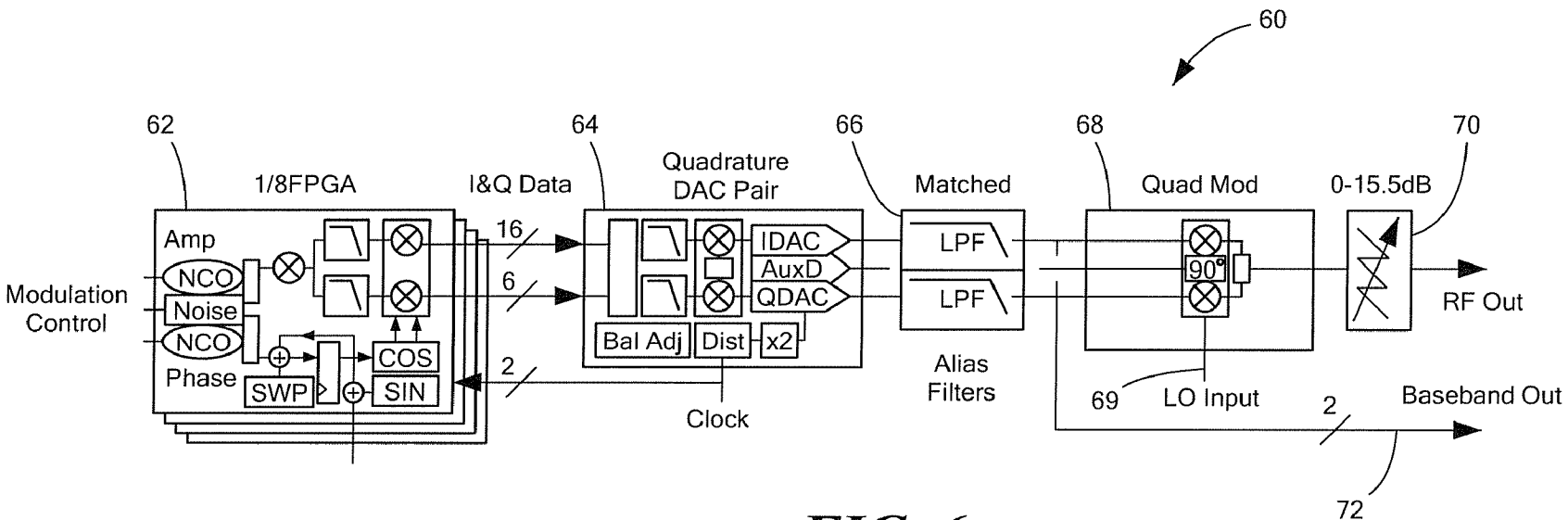
FIG. 6 is a functional block diagram illustrating a single thread architecture.

Referring now to FIG. 6, functionally, each exciter thread 60 comprises an FPGA 62, a dual DAC 64, a pair of matched filters 66, a quadrature modulator 68 and an attenuator 70. One-eight (⅛) refers to the relative size of the FPGA load for a single channel or single digital signal generator. It should be appreciated that as FPGA sizes increase, the number of channels increases. FPGA 62 generates digital I and Q signals for multiple simultaneous countermeasure signals at baseband of DC ±one-half of DAC/FPGA interface data rate while the dual DAC 64 converts the digital baseband spectrum to analog. The phase matched low pass filters 66 are selected having filter characteristics to eliminate DAC alias products. Quadrature modulator 68 receives an LO signal 69 and translates an analog baseband spectrum to RF of LO ±one-half of the DAC clock frequency without expensive image and LO rejection filters. Attenuator 70 is used balance or equalize the amplitude of the RF output signal from the thread 60 with the amplitude of RF output signals generated by other exciter threads. A baseband output is also provided on line 72. The baseband output provides the ability to output frequencies below the range of the quadrature modulator by using direct modulation from the dual DACs and allows operation at frequencies approaching DC.

Allowing independent LOs to be provided to each quadrature modulator 68 provides frequency agility at the expense of added complexity. However, this complexity is balanced by the lower cost to cover the required frequency range and best spurious performance. In one exemplary embodiment, a 2× interpolation filter was selected to modulate the DAC with data at a rate of $f_{DAC}/2$. This implies an upper RF BW of ±100 MHz ($0.4\times f_{DAC}$). Since the passband is ±100 MHz, the I and Q channels must be matched in phase and amplitude response from DC to a frequency of $f_C \geqq 100$ MHz. To further enhance image rejection, minor mismatch between I and Q can be compensated in the DAC and FPGA by adjusting the relative phase and amplitude of the I and Q signals. A small DC offset can be added to the quadrature modulator I and Q inputs and adjusted to reduce, or in some cases minimize, LO feedthrough in the quadrature modulator. In the implementation shown, a pair of auxiliary DC offset D/A converters are provided with the main D/A converters to adjust the DC offset on I and Q for this purpose.

It should, of course be appreciated that other values of interpolation can be used, resulting in a trade-off between system bandwidth, spurious content, and levels of difficulty in implementing the matched analog alias filters.

Figure 7:
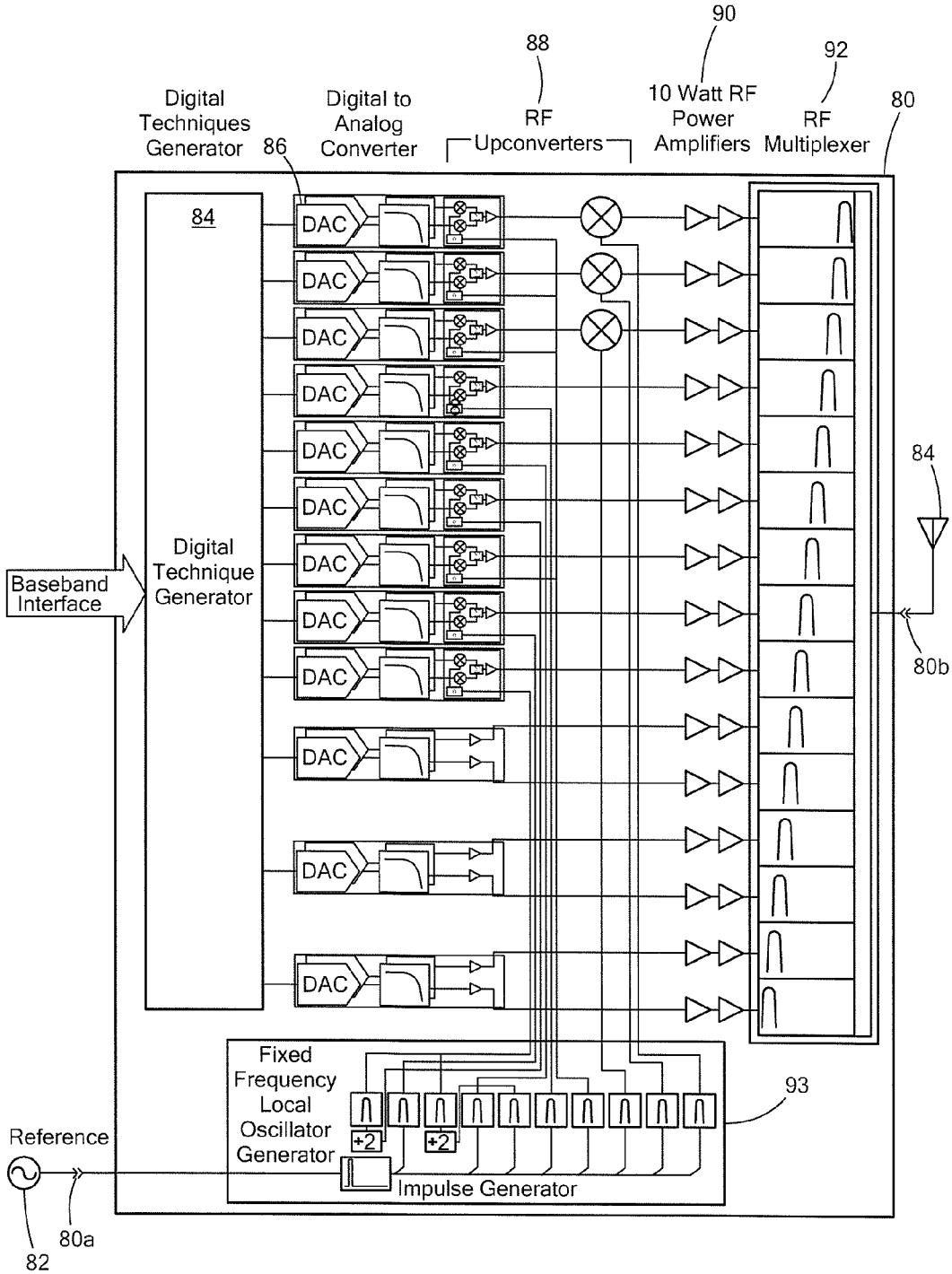
FIG. 7 is a block diagram of a wideband RF jamming signal generator.

Referring now to FIG. 7, a wideband RF jamming signal generator 80 has an input 80*a* coupled to a reference source 82 and an output 80*b* coupled to an antenna 84. The combination of components 80, 82, 84 is sometimes referred to herein as a "jamming system." Wideband RF jamming signal generator 80 includes a digital techniques generator 84 coupled to a digital to analog converter (DAC) 86. The DAC is coupled to an RF upconverter circuit 88. The output of the upconverter circuit 88 is coupled to an amplifier which in turn is coupled to an RF multiplexor 92. Reference source 82 provides a reference signal to a fixed frequency local oscillator generator 93.

The RF architecture illustrated in the exemplary embodiment of FIG. 7 reduces (or in some cases even minimizes) spurious RF signals to address the problem of RF signal fratricide.

RF multiplexer 92 performs a near-lossless combination of the output signals from the multiple signals generated in the individual RF channels. Recommend we include a functional diagram and description of the MUX.

In one prototype system, an external controller (not shown in FIG. 7) utilizes a universal serial bus (USB) interface to control the WB RF jamming techniques generator 80. Software for control and demonstration of the capabilities of the WB RF jamming techniques generator 80 is also included in the controller. In one embodiment, the controller may be provided as a personal computer.

Figure 8:
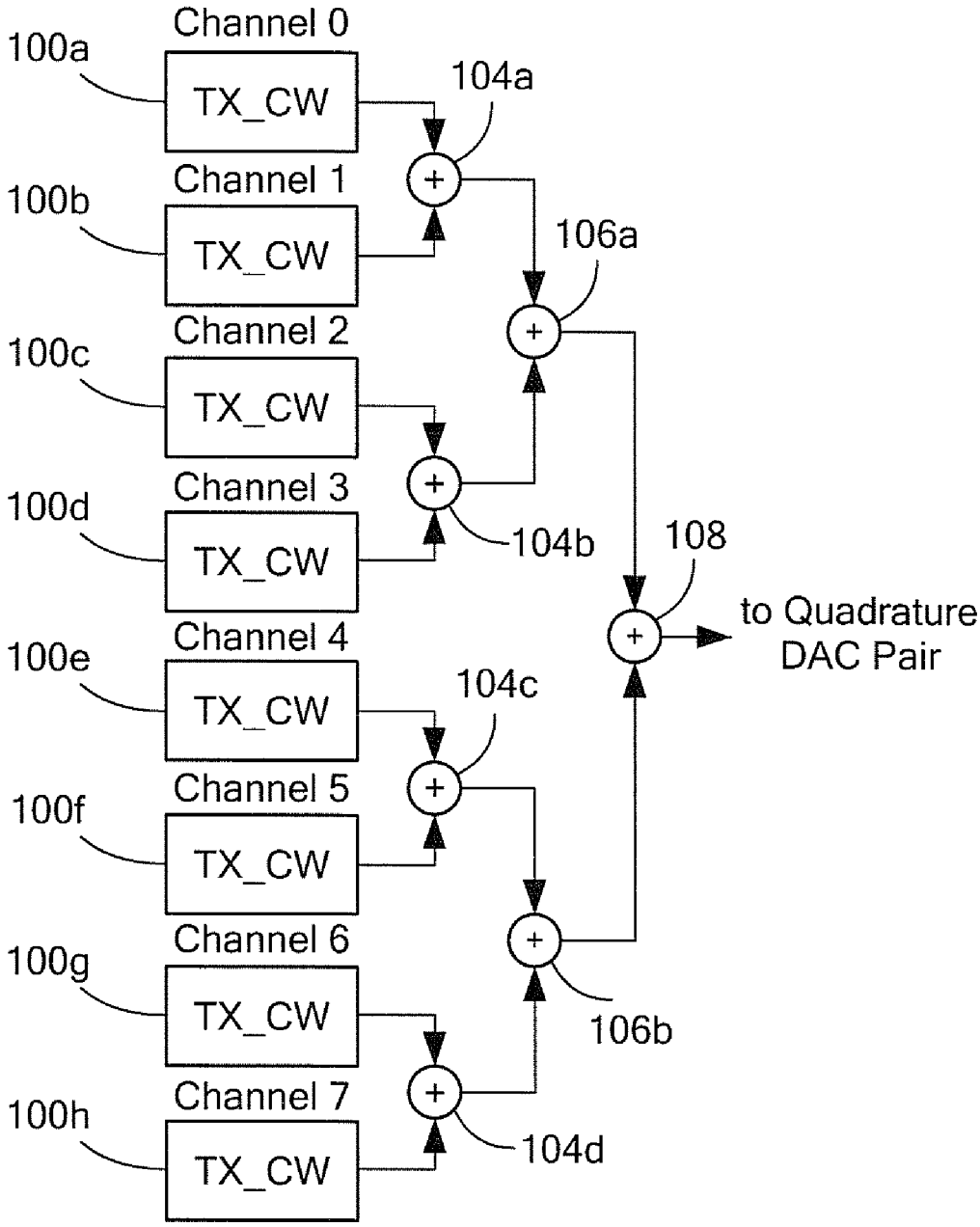
FIG. 8 is a block diagram of a portion of an AM/FM/CW transmit system.
Figure 9:
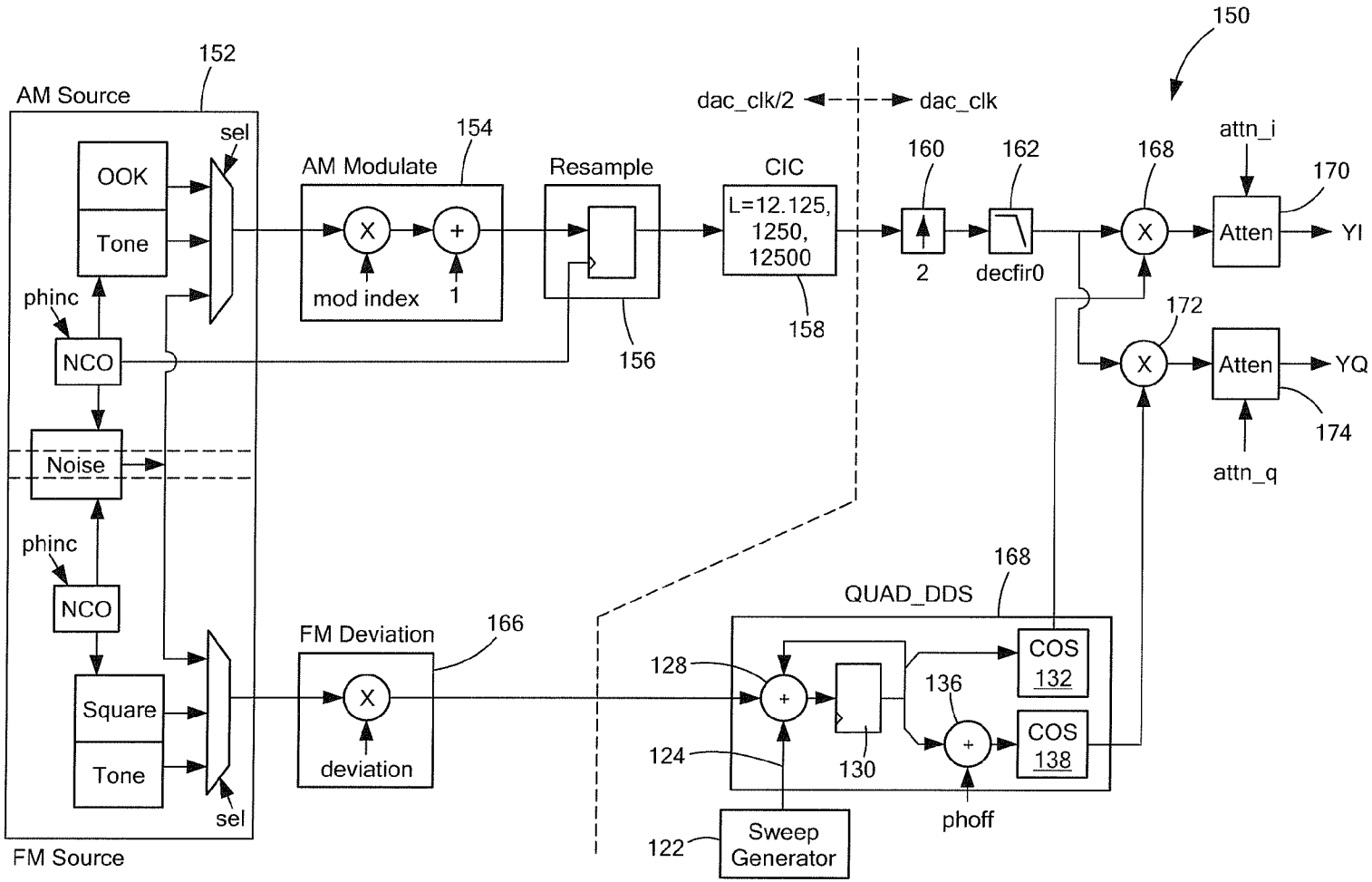
FIG. 9 is a block diagram of an exemplary embodiment of a digital signal generator which may be the same as or similar to digital signal generators described in conjunction with FIG. 8.

Referring now to FIGS. 8 and 9, the digital signal processing design utilizes multiple instantiations of transmit signal processing in order to generate multiple signals. The generation of multiple signals in the processing band can be used to jam multiple RF signal types.

Transmit processing is shown in FIGS. 8 and 9. The system provides jam waveforms for narrowband signals such as AM and FM signals, for example. In addition, narrowband noise spots are also included in the design. By appropriately selecting and combining (or "stacking") the design sections (or threads), this bandwidth is multiplied by the number of threads thus providing contiguous coverage. In lower frequency bands, sub-octave constraining filters limit the bandwidth to less than the 200 MHz possible with the baseband circuitry and the operation of the jamming signals is adjusted accordingly.

Referring now to FIG. 8, this embodiment shows an AM/FM/CW transmit system includes a plurality of independent transmit channels 100*a*-100*h* each of which includes an independent digital signal generator. In the exemplary embodiment of FIG. 8, the transmit system includes eight (8) independent transmit channels 100*a*-100*h* designated as channel 0 through channel 7. It should, of course, be appreciated that in other embodiments, fewer or less than eight channels may be used. The output from pairs of digital signal generators 100*a*-100*h* are combined in corresponding ones of combiners 104*a*-104*d*. Outputs of pairs of combiners 104*a*-104*d* (with combiners 104*a*, 104*b* forming one combiner pair and combiners 104*c*, 104*d* forming another combiner pair) are further combined in combiners 106*a*, 106*b* and the outputs of combiners 106*a*, 106*b* are further combined in a combiner 108. The output of combiner 108 is provided to a DAC (not shown in FIG. 8). Thus, as shown in FIG. 8, a plurality of digital signal generators, here eight digital signal generators 100*a*-100*h*, feed a single DAC. It should be appreciated that the signals from the digital signal generators can be combined using techniques other than that shown in FIG. 8. For example, any signal from any digital signal generator 100*a*-100*h* can be combined (e.g. digitally summed) and fed to the DAC. For example, signals from all eight digital signal generators 100*a*-100*h* can be summed in a single summing circuit and combined to a DAC. Thus signals from multiple independent digital signal generators are digitally summed and fed to a DAC and the DAC outputs multiple independent jamming signals. This technique of summing signals from multiple independent digital signal generators and providing the summed signal to a DAC can be repeated such that multiple DACs each receive summed signals from multiple independent digital signal generators thereby allowing each DAC to provide multiple independent jamming signals.

Referring now to FIG. 9, an exemplary embodiment of a digital signal generator which may be the same as or similar to digital signal generators 100*a*-100*h* described above in conjunction with FIG. 8. Thus, FIG. 9 illustrates an exemplary embodiment of a single digital signal generator (i.e. the embodiment of FIG. 8 would include eight (8) such digital signal generators.

The digital signal generator of FIG. 9 includes a signal source 152, here provided as an amplitude modulated (AM) signal source 152 having a first port coupled to an AM modulator 154. In this exemplary embodiment, the AM signal is either On-Off Keyed, tone modulated or noise modulated depending on the requirement of the desired AM signal. Other modulation techniques may, of course, also be used.

AM modulator provides an appropriately modulated signal to a resampler 156. Resampler 156 receives a sample clock from source 152 which defines a sampling rate. A sampled signal is provided to a cascade integrator comb filter (CIC) 158. CIC 158 provides a signal to a upsampler 160. The signal is then filtered via filter 162 which has a low pass filter characteristic. The so-filtered AM signal is then provided to first and second modulators 166, 172.

Modulators 164, 172 receive respective LO signals via AM source 152, FM deviation circuit 166 (whose FM deviation is an external control input that is provided based on the requirement of the desired FM signal) and a quadrature direct digital synthesizer (QUAD_DDS) circuit 168. Modulators 164, 172 then provide modulated signals through respective ones of attenuators 170, 174 to provide quadrature output signals YI and YQ. In this exemplary embodiment, the desired FM signal is modulated either with a square wave, a sinusoidal tone or Gaussian-filtered pseudo-random noise. Other modulation techniques may, of course, also be used.

Quad DDS circuit 168 receives a signal from modulator 166 and a sweep generator 122 and generates a pair of digital outputs in quadrature which are coupled to modulators 168, 172, respectively. Quad DDS circuit 168 includes an adder 128 which receives signal 124 at an input thereof from a signal generator 122 which may, for example, be provided as a sweep generator 122. Signal generator 122 receives start, stop, increment and dwell signals at input ports thereof from a controller (not shown in FIG. 9). In this exemplary embodiment, an output of adder 128 is coupled to a sampler 130. The output of sampler 130 is coupled to another input port of adder 128 as well as to processing element 132 which provides a digital cosine function.

The output of sampler 130 is also coupled to an input of a second adder 136 which receives a phase offset signal $ph_{off}$ at a second input thereof. Adder 136 thus provides a phase adjusted signal to a processing element 138 which provides a digital cosine function.

Outputs from processing elements 132, 138 are provided to corresponding ones of attenuators 170, 174. Attenuators 170, 174 are responsive to control signals attn_1, attn_q and in response to the respective control signals, attenuators 170, 174 provide a level of attenuation to balance or equalize the amplitude of the digital output signals YI, YQ (i.e., the I data stream and Q data stream) with each other and with the amplitude of RF output signals generated by other exciter threads.

The exemplary embodiment of FIG. 9 illustrates the capability of generating a signal or signal set having widely varied signal characteristics. In essence, any waveform which can be used for jamming can be generated and used. Thus FIG. 9 is an exemplary embodiment of an independently programmable signal generator which feeds one DAC so that multiple signals can be used (i.e. this approach allows a DAC to output multiple independently programmable jamming signals.

In view of the above, it is submitted that the scope of the patent should not be limited to the described embodiments, but rather should be limited only by the spirit and scope of the following claims.

What is claimed is:

1. A jamming system comprising:

a plurality of digital signal generators each of which generates a pair of digital quadrature signals;

a plurality of digital filters, each of the plurality of digital filters having inputs coupled to receive a pair of digital quadrature signals from a corresponding one of said plurality of digital signal generators and to provide filtered quadrature digital signals at a pair of outputs thereof;

a plurality of quadrature digital-to-analog (D/A) converter pairs, each of said plurality of quadrature D/A converters pairs disposed to receive one or more independent pairs of filtered quadrature jamming signals from a corresponding one or more of said plurality of digital filters and to provide one or more independent quadrature signal spectrum pairs at a pair of outputs thereof;

a plurality of quadrature modulators, each of said plurality of quadrature modulators having a first port coupled to receive a first one of the quadrature pairs of analog quadrature signal spectrums from a corresponding one of said quadrature D/A converters, having a second port coupled to receive a second one of the pair of analog quadrature signal spectrums from the corresponding one of said quadrature D/A converters, having a third port configured to receive a local oscillator signal and having an output port at which an output signal is provided;

a plurality of amplifiers, each of said amplifiers having an input port coupled to one or more output ports of a corresponding one or more of said plurality of quadrature modulators and having an output port coupled to the output of the jamming system.

2. The system of claim 1 further comprising a plurality of filters, each of said plurality of filters having an input port coupled to an output port of a corresponding one of said plurality of amplifiers and having an output port coupled to the output of the jamming system.

3. The system of claim 2 wherein each of said plurality of filters is provided having a sub octave band pass filter characteristic.

4. The system of claim 1 wherein each of said plurality of quadrature digital-to-analog (D/A) converter pairs is provided having a first input coupled to receive a first one of the pair of quadrature independent signal spectrums from the corresponding one or more of the plurality of digital filters and a second input coupled to receive a second one of the pair of quadrature independent signal spectrums from the corresponding one or more of the plurality of digital filters.

5. The system of claim 2 wherein each of said plurality of amplifiers is provided as a power amplifier.

6. The system of claim 3 further comprising a like plurality of analog filter pairs, each of said plurality filter pairs having inputs disposed to receive analog signal spectrums from a corresponding one of said plurality of quadrature D/A converter pairs and having an output coupled to an input of a corresponding one of said plurality of quadrature modulators.

7. The system of claim 6 wherein each of said plurality of analog filter pairs is provided having suitable antialiasing characteristics for the corresponding D/A converter pair and signal spectrum.

8. A jamming system for providing multiple independent jamming signals over a multi-octave frequency range comprising:

a plurality of digital signal generators each of which generates a pair of signals in quadrature;

a plurality of digital filter pairs, each of the plurality of digital filters disposed to receive signals from a corresponding one of said plurality of signal generators;

a plurality of quadrature digital-to-analog (D/A) converter pairs, each of said plurality of quadrature D/A converter pairs disposed to receive signals from a corresponding one or more of said plurality of digital filter pairs;

a plurality of quadrature modulators, each of said plurality of quadrature modulators having a first port coupled to receive a first one of the pair of quadrature signal spectrums from a corresponding one of said quadrature D/A converters, having a second port coupled to receive a second one of the pair of quadrature signal spectrums from the corresponding one of said quadrature D/A converters, having a third port configured to receive a local oscillator signal and having an output port at which an output signal is provided;

a plurality of power amplifiers, each of the power amplifiers having an input port coupled to one or more output ports of a corresponding one or more of said plurality of quadrature modulators and having an output port; and a plurality of filters, each of said plurality of filters having a sub octave band pass filter characteristic and each having an input port coupled to an output port of a corresponding one of said plurality of amplifiers and having an output port coupled to the output of the jamming system.

9. The system of claim 7 further comprising a plurality of analog filter pairs, each of said plurality of analog low pass filter pairs having a pair of inputs disposed to receive signals from a corresponding one of said plurality of quadrature D/A converter pairs and having a pair of outputs coupled to a pair of inputs of a corresponding one of said plurality of quadrature modulators.

10. The system of claim 9 wherein said plurality of analog low pass filters, provided in matched pairs correspond to anti-alias filters for the D/A converter. The system of claim 9 wherein said plurality of low pass filters correspond to phase and amplitude matched anti-alias filters.

11. The system of claim 10 wherein said plurality of bandpass filters are provided as a sub-octave filter network provided having filter characteristics selected to reduce intermodulation products and to reduce transmitter spurious signals, reduce RF fratricide and improve interoperability with communications equipment.

12. The system of claim 11 further comprising a plurality of local oscillator (LO) signal sources, each of said plurality of local oscillator signal sources having an input coupled to the LO input of a corresponding one of said plurality of modulators and each of said LO signal sources being independently tunable thereby allowing each modulator output signal to be independently and precisely placed in frequency space.

13. A method for generating multiple independent jamming signals over a multi-octave frequency range, the method comprising:

generating a plurality of independent quadrature digital signal pairs;

digitally filtering the plurality of independent quadrature digital signal pairs;

converting the plurality of independent quadrature digital signal pairs in groups intended for conversion to the same sub octave RF frequency range and within frequency range of a single DAC pair, to quadrature analog signal spectrum pairs;

filtering the quadrature analog signal spectrum pairs with matched analog anti-alias filter pairs to provide filtered quadrature analog signal spectrum pairs;

up-converting the filtered quadrature analog signal spectrum pairs to a desired sub octave RF frequency range;

amplifying the up-converted, filtered analog signal spectrums in sub octave groups; and filtering the amplified, up-converted, filtered analog signal spectrum sub octave groups; and combining the amplified and filtered analog signal spectrum sub octave groups to provide the multiple independent RF jamming signals over a multi-octave RF frequency range.

14. The method of claim 13 wherein up-converting the filtered quadrature analog signals or spectrums to a desired frequency range comprises upconverting the filtered quadrature analog signals or spectrums to a desired frequency range via a quadrature modulator.

15. The method of claim 13 wherein generating a plurality of quadrature digital signals or spectrums comprises digitally generating multiple, independent jam signals in sub-octave bandwidths.

16. The method of claim 15 wherein digitally generating multiple independent jam signals comprises:

generating a digital signal pair using a numerically controlled oscillator (NCO); and modulating the digital signal to provide the plurality of quadrature digital signals.

17. The method of claim 15 wherein digitally filtering the plurality of quadrature digital signals comprises independently digitally filtering each of the plurality of quadrature digital signals in its own sub-octave bandwidth.

18. The method of claim 17 wherein amplifying the up-converted, filtered quadrature analog signals comprises independently amplifying each of the up-converted, filtered quadrature analog signals in its own sub-octave bandwidth.

* * * * *